United States Patent [19]

Herr et al.

[11] 4,120,254

[45] Oct. 17, 1978

[54] DIRECT DRIVE FEED SYSTEM FOR SEWING MACHINES

[75] Inventors: John A. Herr, Garwood; James A. Transue, Union, both of N.J.

[73] Assignee: The Singer Company, Elizabeth, N.J.

[21] Appl. No.: 833,199

[22] Filed: Sep. 14, 1977

[51] Int. Cl.[2] ..... D05B 27/02; D05B 69/10

[52] U.S. Cl. ..... 112/158 E; 112/215; 112/220

[58] Field of Search ..... 112/158 E, 215, 216, 112/220; 310/43

[56] References Cited

U.S. PATENT DOCUMENTS

| | | | |
|---|---|---|---|
| 2,929,344 | 3/1960 | Theenhausen et al. | 112/158 E |
| 3,195,487 | 7/1965 | Reeber | 112/215 |
| 3,343,017 | 9/1967 | Pop | 310/43 |
| 3,783,812 | 1/1974 | Fersch et al. | 112/220 |
| 3,804,044 | 4/1974 | Goetz | 112/220 |
| 3,891,876 | 6/1975 | Herr et al. | 310/43 |
| 3,984,745 | 10/1976 | Minalga | 112/158 E X |
| 4,014,275 | 3/1977 | Herr et al. | 112/158 E |

*Primary Examiner*—Werner H. Schroeder
*Assistant Examiner*—Andrew M. Falk
*Attorney, Agent, or Firm*—Robert E. Smith; Edward L. Bell; William V. Ebs

[57] ABSTRACT

This disclosure relates to a direct drive feed mechanism for sewing machines which is driven by an electronically controlled reversible electric motor and includes a linearly operable feed dog mechanism which is compact in structure and modular in nature. More particularly, the disclosure of this invention relates to a novel four motion feed mechanism for a sewing machine wherein reciprocating feed motion of the feed dog is initiated by a reversible electric motor which in turn is controlled by electronic logic means. Because of the novel structure of this invention, the feed of the fabric by the machine can be readily controlled so as to be capable of producing a plurality of programmed feed patterns.

8 Claims, 4 Drawing Figures

DIRECT DRIVE FEED SYSTEM FOR SEWING MACHINES

BACKGROUND OF THE INVENTION

Sewing machines having electromagnetic actuators directly coupled to the feed mechanism of the sewing machine have been known in the prior art. However, the electromagnetic actuators of such mechanisms were not readily controllable except for substantially an on-off type of actuation. Also, these mechanisms required a plurality of electromagnetic actuators to accomplish the various motions desired in a feed mechanism of a sewing machine, namely, forward and reverse motion as well as up and down motion of the feed dog. Since a plurality of electromagnetic actuators was required, the mechanisms were very cumbersome and required substantial space in the bed of the machine. Further, these mechanisms were relatively slow and were not commercially successful. Recently an electronic sewing machine has appeared on the market which includes an electrical reversible motor for regulating the feed mechanism but, in and of itself, does not directly drive any motion of the feed mechanism. Such a mechanism is illustrated by U.S. Pat. No. 3,984,745 issued to Philip F. Minalga on Oct. 5, 1976, and assigned to the same Assignee as the present invention. Insofar as applicants are aware, however, there is no known sewing mechine feed mechanism which is directly driven by a reversible electric motor, particularly of the rotary armature type, and which can be controlled by electronic logic means.

SUMMARY OF THE INVENTION

It is a prime purpose of the present invention to provide a novel feed mechanism for a sewing machine which is directly driven by a reversible electric motor which motor may be controlled by electronic logic means. The feed mechanism itself is very compact in nature and modular in form and is readily adaptable to so called flat bed or cylindrical bed sewing mechine frames. The feed path of the feed dog in the mechanism of the invention is substantially linear and has the ability to prevent feedback of forces to the feed mechanism control means, as will be more fully explained hereinafter. The reversible electric motor of the invention is preferably a permanent magnet D.C. motor of the type having a nonmagnetic armature disposed within a single air gap formed by peripherally mounted permanent magnets having oppositely polarized pole faces facing the axis of the armature. Such a motor is disclosed in U.S. Pat. No. 3,891,876 issued on June 24, 1975 and assigned to the same Assignee as the present invention. These motors are characterized as being relatively small in size, light in weight and having a high torque-to-inertia ratio, long brush life and freedom from inherent electromagnetic interference. The motor preferably used herein will be more fully described hereinafter. Because of the characteristics of such a motor, it is adapted for relatively rapid reversal in direction of rotation and this characteristic is made use of for controlling the various reciprocating motions of the feed mechanism. Further, the motor is readily receptable to variable control signals as may be produced through logic circuitry, as for example, in the way of timed selectively reversible polarity to bring about rapid reversals in direction of the armature of such motor. Therefore, the motor is capable of variable outputs in accordance with logic input signals to produce variations in the feed output of the feed mechanism.

BRIEF DESCRIPTIONS OF THE DRAWINGS

The invention, both as to its organization and method of operation, together with further objects and advantages thereof will be best understood by referring to the following detailed description taken in connection with the accompanying drawings wherein.

DETAILED DESCRIPTION OF THE INVENTION

Figure 1:
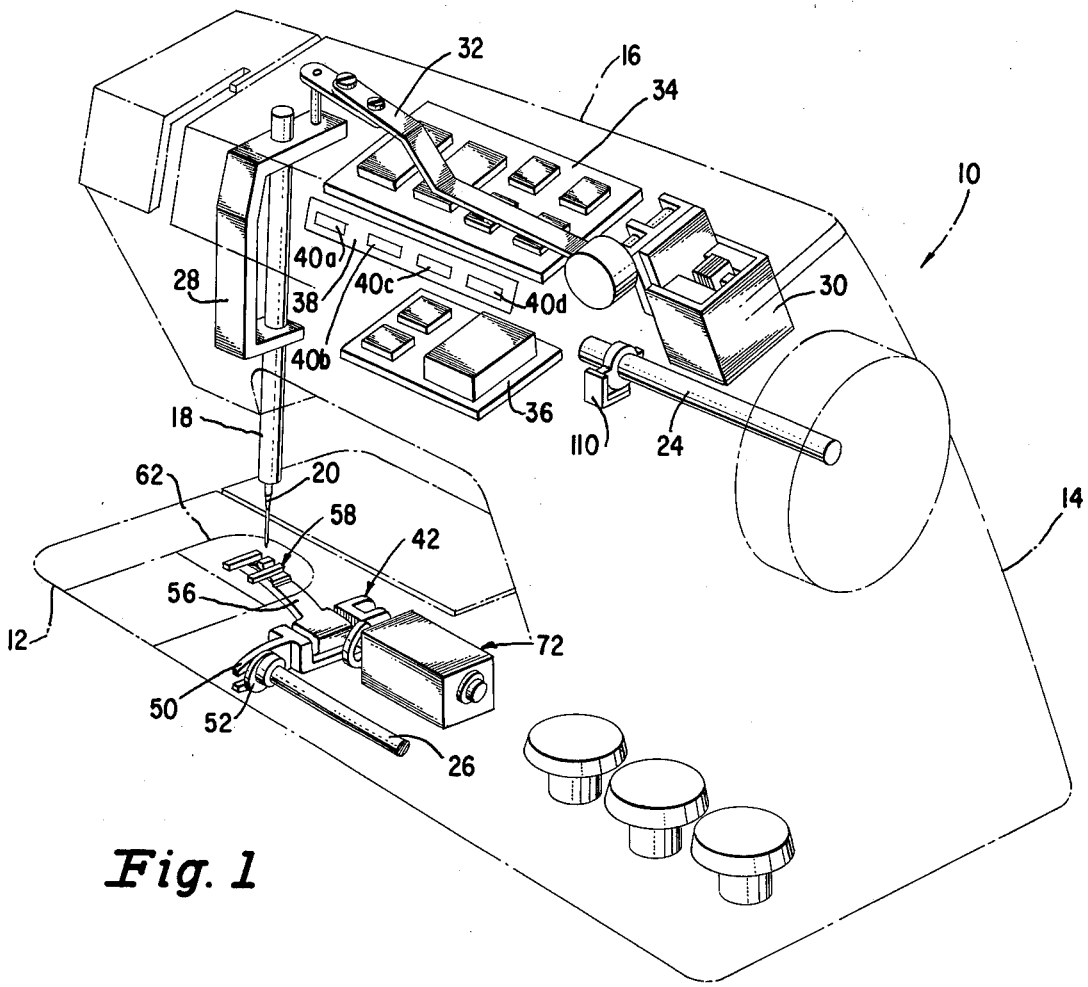
FIG. 1 is a perspective view of a sewing machine with the frame thereof shown in phantom lines and including the necessary physical elements required for operating the needle and feed mechanism thereof.

Referring to FIG. 1 of the drawings, there is illustrated therein a sewing machine frame 10 comprising a bed portion 12 a standard 14 arising from the bed portion 12 and an overhanging arm portion 16. A needle mechanism comprising a needle bar 18 and a needle 20 are supported in the head end portion of the arm 16 for reciprocatory motion therein for penetrating a fabric fed across the surface of the bed 12 and carrying a thread therethrough for cooperation with a rotary loop taker 22 disposed beneath the bed (FIG. 3) such that the needle thread will be carried around a bobbin thread (not shown) for concatination therewith to form lock stitches in a well known manner. The needle bar 18 is driven in its reciprocatory manner by an armshaft 24 suitably connected thereto by an eccentric mechanism (not shown) in a well known manner. The armshaft 24 is suitably driven by an electric motor (not shown) also in a known manner which motor is connected to a bed shaft 26 by a timing belt or the like for driving the same in timed relation with the armshaft 24. The needle bar 18 is supported in a gate 28 which gate 28 is suitably supported for initiating lateral jogging movement of the needle bar 18 to form ornamental stitches such as zigzag stitches or the like.

In order to initiate lateral movement of the gate 28, a reversible electric motor such as a linear actuator of the like shown at 30 is provided and is connected to the needle bar gate 28 by a drive link member 32 in a pivotal manner to initiate lateral jogging of the needle bar 18. The linear motor 30 is driven by electronic control signals provided by electronic logic circuits carried by printed circuit boards, such as shown at 34 and 36, which logic circuits contain such components as an address memory, address counter, a pattern read-only-memory, digital-to-analogue converter circuits and amplification circuits suitable for providing the requisite signals to the linear motor 30 to properly position the needle gate for a desired stitch or pattern of stitches. A pattern selector mechanism 38 is provided on the front panel of the sewing machine frame 10 and includes a plurality of selector buttons 40*a, b, c* and *d* which are operable for selecting a particular pattern associated with each button and which is stored in the memory device. It will be readily apparent that stitch pattern designations may be indicated for each switch by placing the associated stitch indicia adjacent thereto for visual selection by the operator and the operator may therefore select one of the buttons 40*a, b, c* or *d* for a particular pattern which will then be withdrawn from the memory with proper signals being provided to the actuator 30 to position the needle in the requisite spot for reproducing that stitch.

Figure 2:
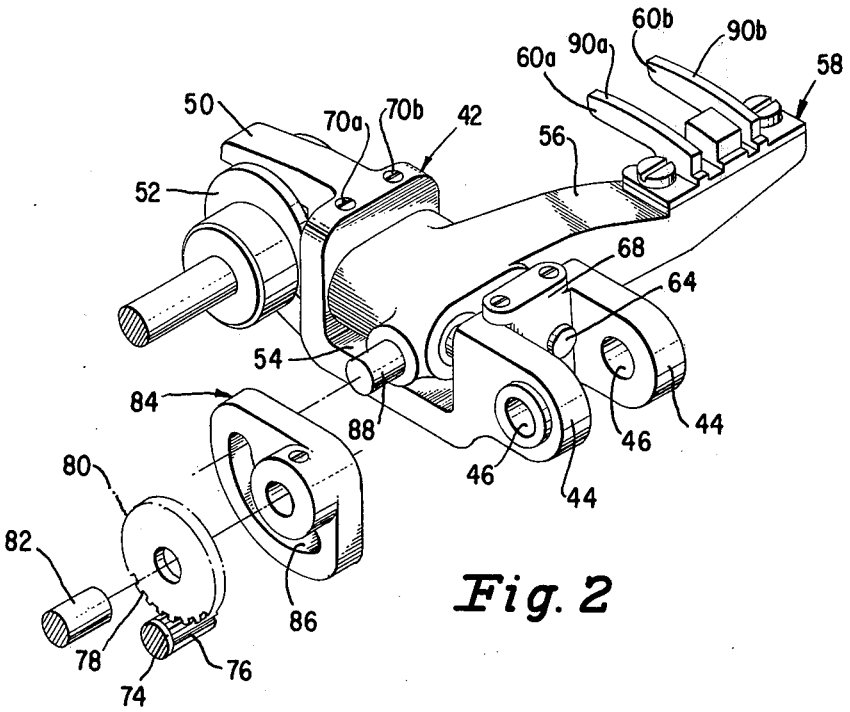
FIG. 2 is an enlarged perspective view of a portion of the feed mechanism of the invention.

As stated above, it is a prime purpose of the present invention to provide a novel feed mechanism for an electronically controlled sewing machine. As best shown in FIGS. 1 and 2, the feed mechanism of the invention includes a carrier guide frame 42 with spaced log portions 44 each having apertures 46 therein for receiving a support pin 48 which pin 48 is fixedly carried by a portion of the housing or frame bed portion 12. The carrier frame 42 is carried on the pin 48 such that it may pivot relative thereto, the purpose of which will be explained hereinafter. On the opposite end of the carrier frame 42 from the legs 44 is a forked portion 50 which is disposed in surrounding engagement with a multi-lobed constant breath cam 52 which is fixedly carried on bed shaft 26. It will be apparent that as bed shaft 26 is rotated, the cam 52 will cause the forked portion to raise and lower as the cam is eccentric thereto and will thus cause the carrier frame member 42 to pivot around the axis of pivot pin 48 which supports the legs 44 and the carrier guide 42. It may be said therefore that the carrier guide frame 42 is caused to have an up and down motion which is initiated by the cam 52 and which may be termed the feed lift motion of the feed mechanism.

With particular reference to FIG. 2, it will be seen that the carrier guide frame 42 is provided with a saddle portion 54 intermediate the forked end 50 and the legs 44 in which is disposed a feed dog carrier 56. A feed dog 58 is carried at one end of the feed dog carrier 56 so that it is removable therefrom as by means of screws of the like as illustrated, and includes a pair of spaced feed dog feet 60*a* and 60*b*. As seen in FIG. 1, the feed dog feet and the feed dog carrier 56 are positioned such that the feed dog feet 60*a* and 60*b* are disposed beneath needle plate 62 and in particular beneath needle plate apertures (not shown) such that the feed dog feet may rise above the needle plate 62 and move in endwise relationship to a fabric disposed thereon for feeding the fabric across the bed surface of the machine in a known manner. The feed dog carrier 56 is supported in the saddle portion 54 of the carrier guide frame in a sliding relationship on pins 64 and 66. The pins 64 and 66 are carried by the carrier guide frame 42 so that they are in fixed relationship thereto and are held in the carrier guide frame 42 by an end cap 68 and in the frame 42 at its opposite end by screws 70*a* and 70*b*. Thus, the feed dog carrier 56 may move linearly relative to the carrier guide frame 42 by sliding on pins 64 and 66.

In order to initiate linear movement of the feed dog carrier 56 relative to the carrier guide frame 42, an electric motor 72 is provided whose structure will be described in more detail hereinafter. The electric motor 72 in general has a rotary motor shaft 74 which is provided with splines or gear teeth 76 at the end adjacent the feed dog carrier and which teeth 76 engage teeth 78 on a gear 80 for reducing the number of revolutions between shaft 74 and a shaft 82. The gear 80 is fixedly carried on the shaft 82 upon which is also fixed a feed traverse cam 84 having an involute or offset radial slot functioning as a cam surface and into which is disposed a cam follower pin 88 carried by the feed dog carrier 56. As will be described in greater detail below, the motor 72 although being a rotary motor, is caused to oscillate through appropriate control circuitry so that the cam 84 will also oscillate. It will be apparent therefore that as the cam 84 oscillates the pin 88 riding in the internal cam surface 86 will be caused to follow a to and fro or back and forth motion on the pins 64 and 66 which will restrict this motion to a linear path. Also, as described above, it will be apparent that the feed dog carrier 56 will also be going through an up and down motion by virtue of being supported by the carrier guide frame 42 which has an up and down motion initiated by the cam 72. As the feed dog carrier is going through the up and down motion, it will also be going through reciprocatory or back and forth motion but which motion will be restricted to a linear path by guide pins 64 and 66. It will be apparent though that there may be some arcuate motion of the feed dog carrier 56 due to the up and down motion of the carrier guide frame 42 and to compensate for any slight arcuate motion, the feed dog feet 60*a* and 60*b* are formed so that their top surfaces 90*a* and 90*b* are slightly arcuate as illustrated in FIG. 2.

Figure 3:
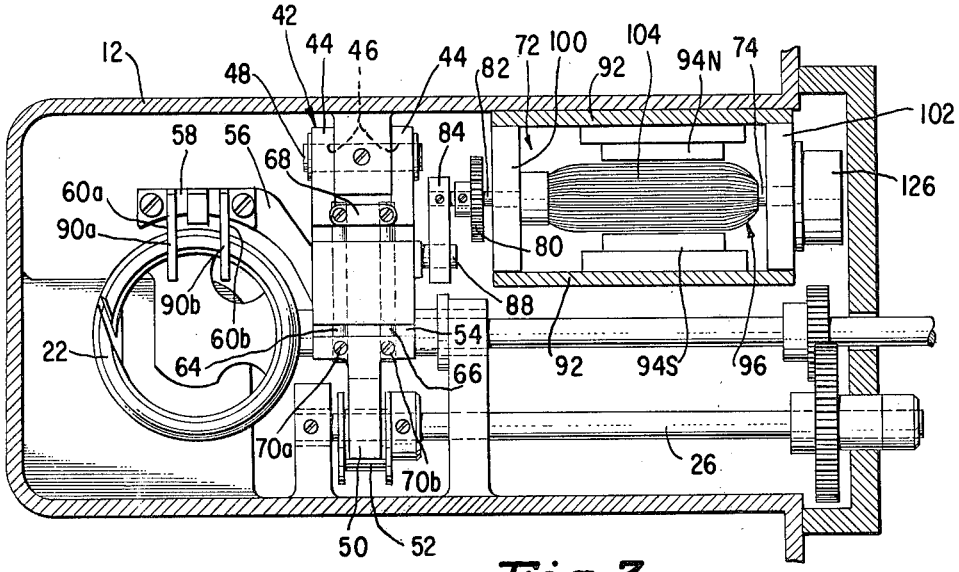
FIG. 3 is a top plan view of a portion of the bed of the sewing machine illustrated in FIG. 1 with portions thereof cut away to illustrate the mechanism.

As briefly described above, the motor 72 used in the combination of the present invention is particularly adapted for achieving the unique results obtained with the combination of the invention. The motor 72 is of the type which may be referred to as a rare-earth magnetic motor and includes a frame 92 made of magnetically permeable material (FIG. 3). Secured to oppositely facing inner surfaces of the frame 10 are block-shaped permanent magnets 94N and 94S which magnets are preferably made of rare-earth cobalt alloys and may be of the type sold under the tradename "LANTHANET". The magnets 94N and 94S are magnetized across the small dimension thereof and when assembled into the motor frame 92 are disposed such that there inner faces present preferably flat poles of opposite polarity as shown in FIG. 3. The space between the magnets 94N and 94S form a single air gap which is the working air gap for the motor. This type of magnet formed in the manner illustrated in the drawings results in a flat pole face structure which provides uniform flux density in the working gap. It will be understood that the frame 92 functions as a low-reluctance return path for the flux supply by the magnets 94N and 94S and produce in the air gap between the poles a working flux field of high flux density due to the large coercive force of the magnets. A solid, non-magnetic cylindrical armature 96 is disposed between the magnets 94N and 94S within the confines thereof and in the air gap. The armature 96 may by made of any non-magnetic material, but it is preferably made of a light weight molded plastic insulating material with the rotor shaft 74 molded integral with the armature. The rotor shaft 74 is journaled in suitable bearings located in the end plates 100 and 102 along with a brush plate (not shown) in one end plate thereof. The armature is formed with longitudinal peripherally-shaped slots (not shown) in which are located windings 104 connected in a conventional manner to commutators (not shown). Brushes (not shown) are also provided to bear against the commutators and provide current conduction to the armature windings from an external voltage source in a manner well known in the art.

Since in this type of armature the armature itself is already formed from electrical insulating material, there is no need for separate slot insulation so that the entire slot space can be more efficiently utilized to contain the armature windings and results in a desirably more copper per slot than would be the case in the conventional iron armature with separate slot insulation. As stated above, the armature 96 contains no magnetic material, except for possibly the shaft 74, which, if necessary, can be made of non-magnetic material, and exerts little or no influence on the distribution of the flux in the air gap and therefore, the magnets 94N and 94S can be most simply formed with flat poles and the air gap flux density will be desirably uniform. This results in a structure in which the armatures have a diameter and length commensurate with the dimensions of the permanent magnets taken transversely of the direction of magnetization. Further, the armature reaction magnetomotive force due to the armature current act substantially at right angles to the field flux axis. Thus, the return path for the armature reaction flux is largely through air and transversely to the magnets 94N - 94S which have substantially the same low permeability as air, being rare-earth alloy materials, resulting in a high reluctance and a low flux. The return path for the field flux is through the frame 92 which is of high permeability resulting in a low reluctance and high flux. This combination of high field flux and low armature reaction flux is highly desirable and results in substantially no distortion in the air gap flux due to armature current. The commutation therefore is not adversely effected by changes in load as in conventional prior art motors. Furthermore, there is substantially no demagnetization effect on the permanent magnets due to armature current which is important to the long term stability of the motor characteristics. Further details of the motor construction may be found in U.S. Pat. No. 3,891,876 issued on June 24, 1975, and assigned to the same Assignee as the present invention.

As briefly mentioned above, motors of this type characterized as being relatively small in size, light in weight and having high torque-to-inertia ratios and are therefore capable of relatively rapid reversal in direction of rotation. Because of the novel low inertia and high accelleration characteristics of the subject motor, rapid changes in direction are possible by varying the polarity of input signals thereto or by changing the timing of changes in polarity, by changing speed or by changing the timing of the on-off cycle of the motor. Advantage is taken of these characteristics of this type of motor in the feed mechanism of the present invention in that by varying the input signals to the motor 72 the cam 84 may be relatively rapidly reversed in direction of the degree of motion in any direction can be regulated by controlling the input signal to the motor 72. As a result, the direction and extent of movement of the feed dog carrier 56 in its back and forth motion can be controlled. As is known in the sewing art, various ornamental patterns for types of sewing can be accomplished through combinations of variations in the feed of the fabric and location of penetration points of the needle. Thus by varying the feed of the fabric through the novel feed mechanism of the invention, it is possible to create desired stitch patterns.

Figure 4:
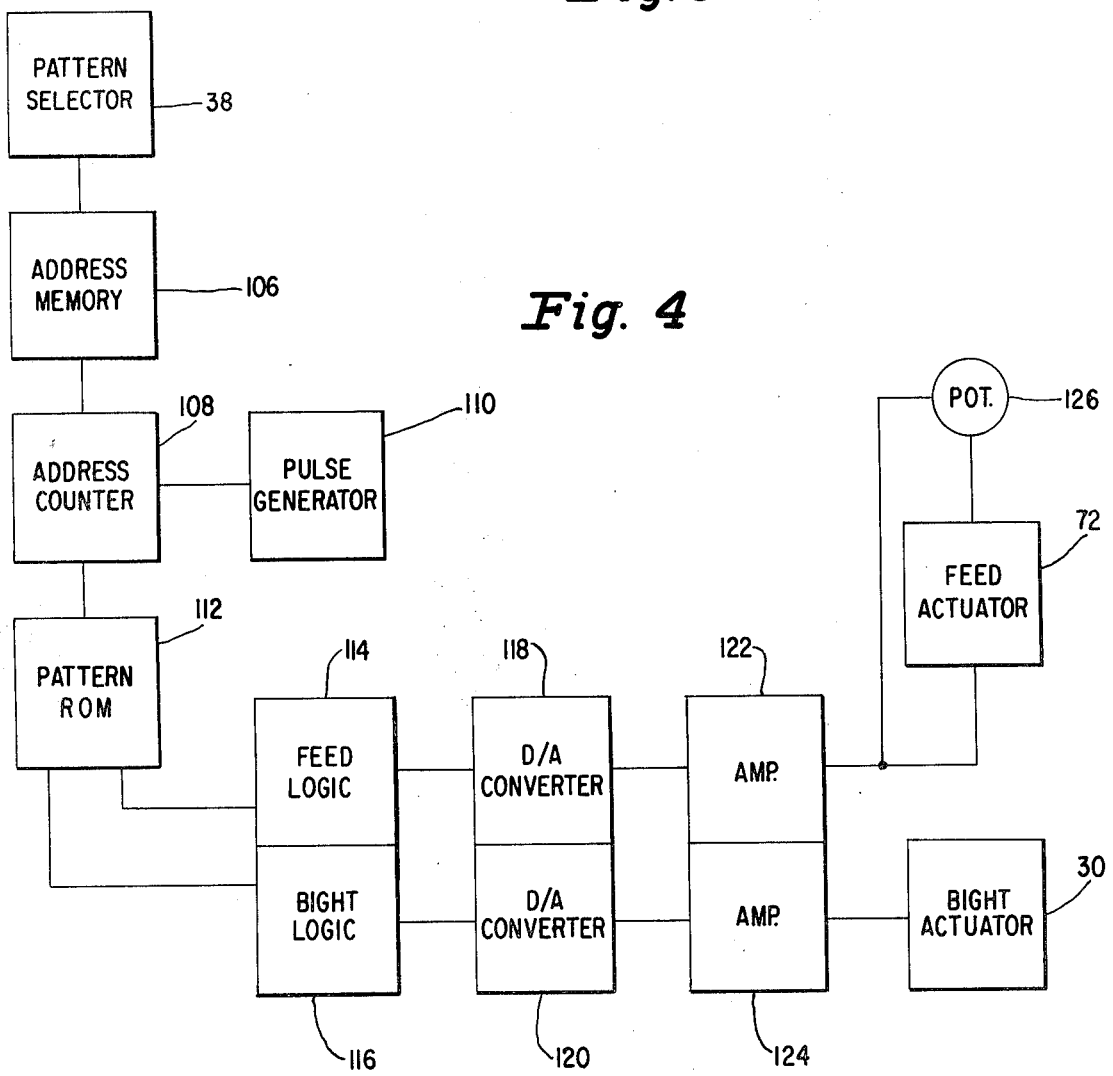
FIG. 4 is a block diagram illustrating the electronic control of the sewing machine of the invention.

Referring now to FIG. 4, there is diagrammatically shown therein electronic control circuitry for providing stitch patern control signals and in particular such stitch pattern control signals to the motor 72 and the actuator 30. The printed circuit boards 34 and 36 contain solid state electronic components which are diagrammatically illustrated in FIG. 4. Also shown in FIG. 1, on the front panel is the pattern selection switch mechanism 38 which is diagrammatically illustrated as the pattern selector 38 in FIG. 4. The pattern selector 38 is connected to an address memory 106 which contains encoded data in binary form to produce a predetermined specific binary number on its output lines for a pattern selected on the pattern selector 38. An address counter 108 is provided and is coupled with a pulse generator 110 and connected to the armshaft 24 so that the data from the address memory will be addressed to a pattern read-only-memory 112 in timed relation of the operation of the sewing machine. The pattern read-only-memory has stored therein the stitch position coordinate data for the needle and the feed mechanism to produce ornamental patterns corresponding to the selections on the switch selector 38. It should be understood, however, that a programmable or random access memory could be used in lieu of or in combination with a read-only-memory for selectively storing stitch position coordinate data. When the read-only-memory 112 is addressed with particular coded words, pattern information will be released and will be fed to feed and bight logic circuits 114 and 116 which are in digital form and will be converted to analog signals by digital-to-analog converters 118 and 120, there being one such converter for the feed circuit and one for the bight or needle circuit. The signals from the converters 118 and 120 are amplified by amplifiers 122 and 124 with the amplified signals then being fed to the actuator 30 in the case of the needle and the motor 72 in the case of the feed. The reversible electric motor 72 may also be provided with a potentiometer 126 connected to the shaft 74 thereof to sense the position of the shaft and compare it with the signal fed into the feed actuator so that a corrective signal may be provided if the motor is not approaching the desired position. Likewise, a potentiometer may also be provided for the bight actuator 30 shown in FIG. 4 if desired. Reference should be made in U.S. Pat. No. 3,984,754 mentioned above for a more detailed description of a servo mechanism which may be used with actuator as described herein and in a similar environment for insuring that the actuator is at the proper coordinate position as determined by the stitch position coordinate information withdrawn from the read-only-memory.

It will be apparent therefore that by selection of a desired switch 40*a, b, c* or *d* for a particular pattern, information will be withdrawn from the electronic circuitry and appropriate input data signals will be supplied to the reversible motor 72 to determine the direction and extent of travel of shaft 74 of said motor. If follows that, by controlling the output direction and extent of turning of the shaft 74 of the motor 72, the cam 84 will likewise be rotated in accordance with the input signals from the electronic circuitry and as a result control the extent and direction of motion of the feed dog 58.

As can be seen from the above detailed description, a novel feed mechanism and a novel combination with electronic controls means is provided with the feed mechanism being relatively simple in construction, compact in size modular in form and can be conveniently fit within flat bed type sewing machines or what is known as a cylinder bed type sewing machine. It will also be seen that the relatively complex and multi-part feed regulator mechanisms of the purely mechanical type commonly used in sewing machines presently are no longer required since the regulation of the linear feed of the fabric can be carried out through the relatively simple construction of the invention. While the invention has been described herein in its preferred embodiment, it will be obvious to those skilled in the art that various changes and modifications can be made therein without departing from the spirit and scope thereof as defined in the appended claims.

Having thus set forth the nature of this invention, what we claim herein is:

1. In a sewing machine have an endwise reciprocable thread carrying needle supported for penetrating a fabric to form stitches therein, a work feed mechanism including a feed dog for moving fabric across a work surface of said sewing machine, support means for said feed dog including a guide frame mounted on the machine for reciprocation in one plane and a feed dog carrier mounted for linear reciprocation in the guide frame in another plane perpendicular to the plane of reciprocation of the guide frame, and driving means connected to the support means for imparting reciprocatory motion to the guide frame and feed dog carrier in the said one and another plane respectively during operation of the machine, the driving means including a low inertia, permanent magnet rotary electrically reversible motor.

2. In a sewing machine as recited in claim 1 further comprising means for converting rotary motion from said motor into substantially linear motion for said feed dog.

3. In a sewing machine as recited in claim 1 wherein said motor drives the feed dog carrier.

4. In a sewing machine means as recited in claim 2 wherein said means for converting rotary motion from said motor into substantially linear motion for said work feed element comprises cam means operative between said motor and said feed dog carrier.

5. In a sewing machine as recited in claim 1 wherein said motor comprises a frame of magnetic material, permanent magnet means secured to said frame in opposing polar relationship and defining a single air gap therebetween, and a solid non-magnetic armature disposed within said air gap.

6. In a sewing machine as recited in claim 1 further comprising control circuit means for said motor, said control circuit means being operative for converting feed pattern positioned coordinate information into electrical control signals for selectively controlling said motor and the motion of said work feed element.

7. In a sewing machine as recited in claim 6 wherein said control circuit means includes memory means for storing feed pattern positioned data; means for withdrawing said data in timed relationship to the operation of said sewing machine in accordance with a predetermined pattern selection, and means for converting said data into usable electrical control signals for controlling said motor.

8. In a sewing machine as recited in claim 7 further comprising jogging means for initiating relative lateral movement of said needle for forming zig-zag stitches, said jogging means including electric motor bight actuator means operatively connected to said needle, and said control circuit means being operative for converting needle position coordinate information into usable electrical control signals for selectively controlling said electric motor bight actuator means in accordance with a predetermined pattern selection.

* * * * *